US012012874B2

(12) United States Patent
Schnell et al.

(10) Patent No.: US 12,012,874 B2
(45) Date of Patent: Jun. 18, 2024

(54) SWITCHING ELEMENT FOR A VALVE TRAIN OF AN INTERNAL COMBUSTION ENGINE

(71) Applicant: Schaeffler Technologies AG & Co. KG, Herzogenaurach (DE)

(72) Inventors: Oliver Schnell, Veitsbronn (DE); Michael Neumann, Erlangen (DE); Peter Sailer, Erlangen (DE); Frank Himsel, Obermichelbach (DE); Johannes Roith, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/103,525

(22) Filed: Jan. 31, 2023

(65) Prior Publication Data

US 2023/0243280 A1 Aug. 3, 2023

(30) Foreign Application Priority Data

Feb. 1, 2022 (DE) ..... 10 2022 102 242.0

(51) Int. Cl.
*F01L 1/14* (2006.01)
*F01L 1/24* (2006.01)
*F01L 1/46* (2006.01)

(52) U.S. Cl.
CPC ..... *F01L 1/14* (2013.01); *F01L 1/2422* (2013.01); *F01L 1/46* (2013.01)

(58) Field of Classification Search
CPC ... F01L 1/146; F01L 13/0031; F01L 13/0005; F01L 2305/00; F01L 1/24;
(Continued)

(56) References Cited

U.S. PATENT DOCUMENTS 6,497,207 B2 12/2002 Spath et al.
7,673,601 B2 * 3/2010 Spath ..... F01L 1/146 123/90.15

(Continued)

FOREIGN PATENT DOCUMENTS

DE 10204673 A1 * 8/2003 ..... F01L 1/146
DE 10245301 A1 * 4/2004 ..... F01L 1/146

(Continued)

OTHER PUBLICATIONS

DE-202020105299-U1, English Language Machine Translation (Year: 2020).*

*Primary Examiner* — Wesley G Harris

(57) ABSTRACT

The disclosure relates to a switching element comprising an external part and an internal part, which is axially displaceable in a bore of the external part. At least one radially displaceable locking element is disposed within at least one receptacle of the internal part and includes a flattened portion on a radially outwardly directed end. At least one recess of the external part can be acted upon by a control pressure and the at least one locking element can thereby be radially displaced from the locking position into a release position. At least in a respective locking position, a chamber delimited by the at least one locking element is spatially separated from the at least one recess of the external part by a respective locking section. At least one bypass is designed, which indirectly fluidly connects the at least one recess of the external part and a respective chamber.

20 Claims, 10 Drawing Sheets

(58) Field of Classification Search
CPC ..... F01L 2001/2427; F01L 1/245; F01L 2307/00; F01L 1/14; F01L 2001/256; F01L 1/2422; F01L 1/46
USPC ..... 123/90.55, 90.16, 198 F, 90.48, 90.5
See application file for complete search history.

(56) References Cited

U.S. PATENT DOCUMENTS

| | | | | |
|---|---|---|---|---|
| 2002/0195072 | A1* | 12/2002 | Spath | F01L 13/0005 123/90.16 |
| 2005/0005884 | A1* | 1/2005 | Geyer | F01L 1/146 123/90.55 |
| 2005/0045132 | A1* | 3/2005 | Hendriksma | F01L 13/0005 123/90.59 |
| 2005/0132993 | A1* | 6/2005 | Sailer | F01L 1/146 123/90.55 |
| 2007/0295293 | A1 | 12/2007 | Spath et al. | |
| 2010/0229811 | A1* | 9/2010 | Schafer | F01L 1/2405 123/90.52 |

FOREIGN PATENT DOCUMENTS

| | | | | |
|---|---|---|---|---|
| DE | 102005020580 | A1 * | 11/2006 | F01L 1/146 |
| DE | 102005020580 | A1 | 11/2006 | |
| DE | 102015209778 | A1 * | 12/2016 | F01L 1/12 |
| DE | 202020105299 | U1 * | 12/2020 | F01L 1/146 |
| EP | 1472438 | B1 | 7/2005 | |
| KR | 100507208 | B1 * | 8/2005 | F01L 1/14 |
| KR | 100507208 | B1 | 8/2005 | |

* cited by examiner

SWITCHING ELEMENT FOR A VALVE TRAIN OF AN INTERNAL COMBUSTION ENGINE

CROSS-REFERENCE TO RELATED APPLICATIONS

This application claims priority under 35 U.S.C. Section 119 of German Patent Application No. DE 10 2022 102 242.0 filed on Feb. 1, 2022, the disclosure of which is incorporated herein by reference.

TECHNICAL FIELD

The disclosure relates to a switching element for a valve train of an internal combustion engine.

BACKGROUND

EP 1 472 438 B1 discloses a switching element for a valve train of an internal combustion engine, wherein this switching element comprises an external part and an internal part that can be displaced relative thereto. The internal part is axially displaceably guided in a bore in the external part and is used for coupling to a push rod, while the external part rotatably supports a roller on which contact with a lifting cam of a camshaft is made when the switching element is in the installed state in the valve train. The internal part and the external part can be positioned relative to one another in a coupling position, in which the external part and the internal part can be positively coupled to one another via locking elements. Thus, in the coupled position, there is a recess in the external part which overlaps with a receptacle which is designed on the internal part and in which the locking elements are each guided in a radially displaceable manner.

The individual locking element is pretensioned in the direction of a locking position in which the respective locking element is enclosed in the coupling position of the external part and internal part on the front side with a locking section in the recess of the external part, and thereby causes the internal part to be coupled to the external part in the axial direction. By applying pressure to the recess of the external part and thus applying pressure to the front side of the locking elements, these can be displaced back completely into the receptacle of the internal part and the coupling can thus be canceled. The respective locking section is defined on the individual locking element by a flattened portion, with which the individual locking element is provided on a radially outwardly directed end. In this case, a respective chamber is divided off by the respective locking section in the respective locking position of the individual locking element, which is thereby spatially separated from the recess of the external part.

Proceeding from the prior art described above, it is now the object of the present disclosure to create a switching element for a valve train of an internal combustion engine, wherein this switching element is distinguished by improved switching characteristics.

SUMMARY

According to the disclosure, a switching element comprises an external part and an internal part, which is accommodated in a bore of the external part so that it can be axially displaced with respect to the external part and can be displaced relative to the external part into a coupling position in which at least one radially extending receptacle of the internal part overlaps at least one radially extending recess of the external part. In addition, at least one locking element is provided, which is guided in a radially displaceable manner in the at least one receptacle and which is provided with a flattened portion on a respective radially outwardly directed end, wherein one flattened portion on a respective radially outwardly directed end of the at least one locking element defines a respective locking section with which the at least one locking element in its locking position and the coupling position of the internal part and the external part encloses the at least one recess of the external part. A control pressure can be applied to the at least one recess of the external part, thereby radially displacing the at least one locking element from the locking position to a release position in which the at least one locking element is fully inserted into the at least one receptacle. At least in the one respective locking position, a chamber delimited by the at least one locking element is spatially separated from the at least one recess of the external part by the respective locking section.

The external part and the internal part of the switching element according to the disclosure can each be designed as a cylindrical body, wherein the external part then defines the bore as a hollow cylinder in which the internal part is guided so that it can be axially displaced relative to the external part. In particular, a spring set having at least one spring element is accommodated between a bottom of the external part defined by the bore and an end face of the internal part facing this bottom, via which the internal part is pretensioned axially in the direction of extension of the internal part from the external part. The external part can also support a roller, with which the external part is in contact, in particular with a lifting cam of a camshaft of the valve train, when the switching element is in the installed state. In this respect, the switching element is designed in the manner of a roller tappet. The internal part is intended in particular for a contact with at least one gas exchange valve of the valve train when the switching element is in the installed state, wherein this contact can be made indirectly via at least one intermediate follower member, which can be a push rod. In particular, a play compensation element is also accommodated in the internal part, on which the contact of the internal part with the at least one follower member is made.

In the context of the disclosure, "axial" means an orientation in the direction of the longitudinal center axes of the internal part and the external part. "Radial" means an orientation in the diameter direction of the internal part and the external part and thus transverse to their longitudinal center axes.

The external part and the internal part can be positioned relative to one another in the coupling position by corresponding axial displacement of the internal part in the external part, in which an axial coupling of the external part and the internal part can be brought about. In the present case, this is realized via at least one locking element, which is slidably guided in at least one receptacle of the internal part, wherein this at least one receptacle thus extends radially. On the side of the external part there is a radially aligned recess which in the coupled position overlaps, or aligns with the at least one receptacle of the internal part. The at least one locking element can be displaced in the radial direction in the at least one receptacle of the internal part and thereby positioned in a locking position in which the at least one locking element can be enclosed with a respective locking section in the at least one receptacle when the external part and the internal part engage in the coupling position of the external part, and thereby causes a positive coupling of the internal part and the external part in the axial direction.

In an example embodiment, the at least one receptacle of the internal part is designed as a radially running through bore, in which two radially opposed locking elements are slidably guided, wherein these two locking elements are thus positioned in their locking positions in relation to the internal part with their locking sections protruding radially outwards and thus in the coupling position of external part and internal part can respectively be enclosed in the at least one recess of the external part. On the side of the external part, there can be one recess, wherein this in particular comprises an annular groove which is formed circumferentially on an inner diameter of the external part at the corresponding axial height. In an example embodiment, this annular groove is formed with a greater extent in the axial direction than the receptacle of the internal part.

The at least one locking element is in particular pretensioned in the respective locking position and, when the external part and internal part are positioned in the coupled position, engages with the respective locking section defined on the front side in the recess of the external part. The respective locking position in the coupling position of the external part and the internal part is defined in that the respective locking element is prevented from further displacement radially outwards by frontal contact on the respective locking section. The respective locking section is defined by a flattened portion with which the at least one locking element is provided at a radially outer end. The respective flattened portion is designed in particular as a recess that runs from the end with a specific extension in the radial direction, wherein, when implementing the at least one locking element as a cylindrical body in the corresponding region, this flattened portion thereby reduces the otherwise circular cross-section of the body by a defined circular segment.

The pretensioning of the at least one locking element in the respective coupling position thereof can be carried out within the meaning of the disclosure via a spring element, wherein the individual locking element is displaced radially into the receptacle of the internal part against this spring element. In the release position, the individual locking element is displaced completely into the receptacle of the internal part, whereby the respective positive fit between the internal part and the external part is canceled via this locking element, and the two parts can be displaced axially relative to one another. The individual locking element is displaced back by applying pressure to the recess of the external part, which in the coupled position of the internal part and external part results in pressure being applied to the respective end face of the individual locking element. In an example embodiment, the pressurization takes place with hydraulic fluid, so that the switching element is designed as a hydraulic switching element in this case.

A respective flattened portion of the at least one locking element defines an anti-rotation section, in which an anti-rotation means can be enclosed and which can prevent the positive fit of at least one locking element from undesired rotation in the receptacle. This anti-rotation means can be in the form of a circlip, which is accommodated in a groove which runs circumferentially on an outer jacket of the internal part and merges into the receptacle, i.e., is configured to be axial at the height of the receptacle. Together with the receptacle of the internal part and the radially surrounding external part, each flattened portion also delimits a chamber, the size of which changes with the displacement of the respective locking element and which, at least in the respective locking position, is spatially separated from the at least one recess of the external part by the respective locking section external part.

The disclosure now comprises the technical teaching that at least one bypass is designed which indirectly fluidly connects the at least one recess of the external part and a respective chamber at least until a respective chamber is directly fluidly connected to the at least one recess in the course of the displacement of the at least one locking element. In other words, at least one bypass is provided in the switching element according to the disclosure, which is used to indirectly fluidly connect the at least one recess of the external part to the respective chamber. This indirect fluid connection via the at least one bypass is carried out at least until the at least one recess of the external part and a respective chamber are directly fluidly connected to one another when the at least one locking element is displaced.

Such a configuration of a switching element has the advantage that the indirect fluid connection established via the at least one bypass when pressure is applied to the recess of the external part can also directly supply pressure to a respective chamber, although the chamber and recess are still spatially separated from one another by a respective locking section. On the one hand, this avoids the effect that the chamber, which enlarges in the course of the displacement of the associated locking element, can only be filled up when the associated locking element has been displaced so far in the direction of the respective release position that the respective locking section releases the chamber with respect to the recess of the external part. Thus, this delayed filling would otherwise result in a drop in pressure when the pressure is applied, and thus also in a delay in the displacement of the at least one locking element. On the other hand, pressure can be applied to the front of the locking element on a larger surface. Overall, an improved switching characteristic of the switching element can be achieved.

In contrast, with the switching element of EP 1 472 438 B1, the respective chamber can only be filled when the associated locking element has been displaced so far into the receptacle of the internal part that separation from the recess of the external part by the respective locking section of the associated locking element occurs. This results in a drop in the control pressure and thus also in a delay in the displacement of the associated locking element.

In the switching element according to the disclosure, the at least one bypass is intended to indirectly fluidly connect the at least one recess of the external part and a respective chamber in the course of the displacement of the at least one locking element until there is a direct fluid connection between a respective chamber and the at least one recess. A direct fluid connection between the at least one recess of the external part and the chamber means that a medium can flow directly from the at least one recess into the chamber, wherein this is the case after a certain radial displacement of the locking element from the locking position to the release position. The at least one bypass allows the medium to flow indirectly from the at least one recess into the chamber, at least until this aforementioned direct fluid connection is established. There can be either a permanent indirect fluid connection via the at least one bypass, or there is an indirect fluid connection only over a partial section of the radial displacement of the at least one locking element, namely over the partial section in which the direct fluid connection between the chamber and the at least one recess does not yet exist.

According to an embodiment of the disclosure, the at least one bypass is formed by a cut-out, which widens the receptacle at least in the sections in the mouth region thereof onto an outer jacket of the internal part and runs radially far enough into the receptacle that at least as long as there is a transfer from the at least one recess of the external part past the at least one locking element into which a respective chamber is placed until a respective chamber is directly fluidly connected to the at least one recess of the external part. Advantageously, a bypass can thereby be formed in a simple manner by machining the receptacle in the internal part, wherein a radial extension of the cut-out from the mouth region into the receptacle defines how long the passage past the at least one locking element can take place. A permanent fluid connection between the recess of the external part and the chamber via the cut-out can also be produced here if necessary. A plurality of such cut-outs can be formed on the wall of the receptacle. In particular, the respective cut-out(s) is/are also provided in a force-free region of the receptacle.

Alternatively or additionally to the aforementioned embodiment, the at least one bypass is formed by a depression that is designed on an outer jacket of the internal part and fluidly connects the at least one recess of the external part to a groove. The groove on the outer jacket of the internal part runs all the way around and is used to hold an anti-rotation means for the at least one locking element in the receptacle, wherein the circumferential groove merges into a respective receptacle. In this way, too, a bypass can be implemented in a simple manner, by making the depression manufactured to fluidly connect the recess of the external part to the groove on the outer jacket of the internal part. As a result, a medium can pass from the recess of the external part via the depression into the groove and then also pass into the chamber due to the fluid connection of the groove to the recess and thus also to the chamber. A permanent, indirect fluid connection of the recess of the external part and the chamber can be realized as a result. In a further development of this variant, the depression is either slot-shaped or circular.

Further alternatively or additionally, the at least one bypass is formed by a respective depression which is designed on an inner jacket of the external part formed by the bore and fluidly connects the at least one recess of the external part to the at least one receptacle of the internal part. As a result, a bypass can also be implemented in a simple manner.

Another possible embodiment of the disclosure, which can be implemented here alternatively or additionally to one or more of the aforementioned variants, is that the at least one bypass is formed by a respective cut-out that is introduced into the at least one locking element. In a further development of this possible embodiment, a respective cut-out on a surface of the at least one locking element is introduced into a contact surface, which is defined on the surface by each flattened portion and with which the at least one locking element rests axially on the external part in the locking position. Alternatively or additionally thereto, a respective cut-out is formed tangentially on a cylindrical guide surface on which the at least one locking element is radially displaceable in the at least one recess of the internal part, wherein a respective cut-out, due to its position on the guide surface, allows a passage from the at least one recess of the external part past the at least one locking element into the respective chamber at least until the respective chamber is directly fluidly connected to the at least one recess of the external part.

These possible embodiments again allow a medium to pass from the at least one recess of the external part, past the at least one locking element, and into a respective chamber. The individual cut-out can be in the form of a slot or a notch.

According to a further embodiment of the disclosure, which can also be combined with one or more of the aforementioned variants, the at least one bypass is formed by a respective channel which is defined in the at least one locking element and which opens into the respective chamber. In this way, an indirect fluid connection and thus a supply of a medium from the at least one recess of the external part into a respective chamber through the at least one locking element can be implemented. In this case, a respective channel can extend, starting from a front face of a respective locking section, to a respective chamber, whereby a permanent fluid connection with a respective chamber is realized via the respective channel. Alternatively thereto, a respective channel can also run from a cylindrical guide surface, on which the at least one locking element is guided in a radially displaceable manner within the at least one receptacle of the internal part. In this case, above a certain radial displacement of the at least one locking element, the opening of the channel on the guide surface of the at least one locking element can be closed by the surrounding wall of the recess, so that here the indirect fluid connection can only be realized as a bypass via a partial section of the radial displacement of the locking element.

Alternatively or additionally to the aforementioned variants, a respective channel is formed by a bore in the at least one locking element, wherein this one bore extends obliquely in the case of the opening of a respective channel on the front face of a respective locking section. Alternatively thereto, a respective channel can also be formed by a plurality of bores which meet within the at least one locking element and correspondingly define a respective channel.

For this disclosure, there are possibilities of combining individual features with one another that are either described herein or shown within the figures.

DETAILED DESCRIPTION

Figure 1:
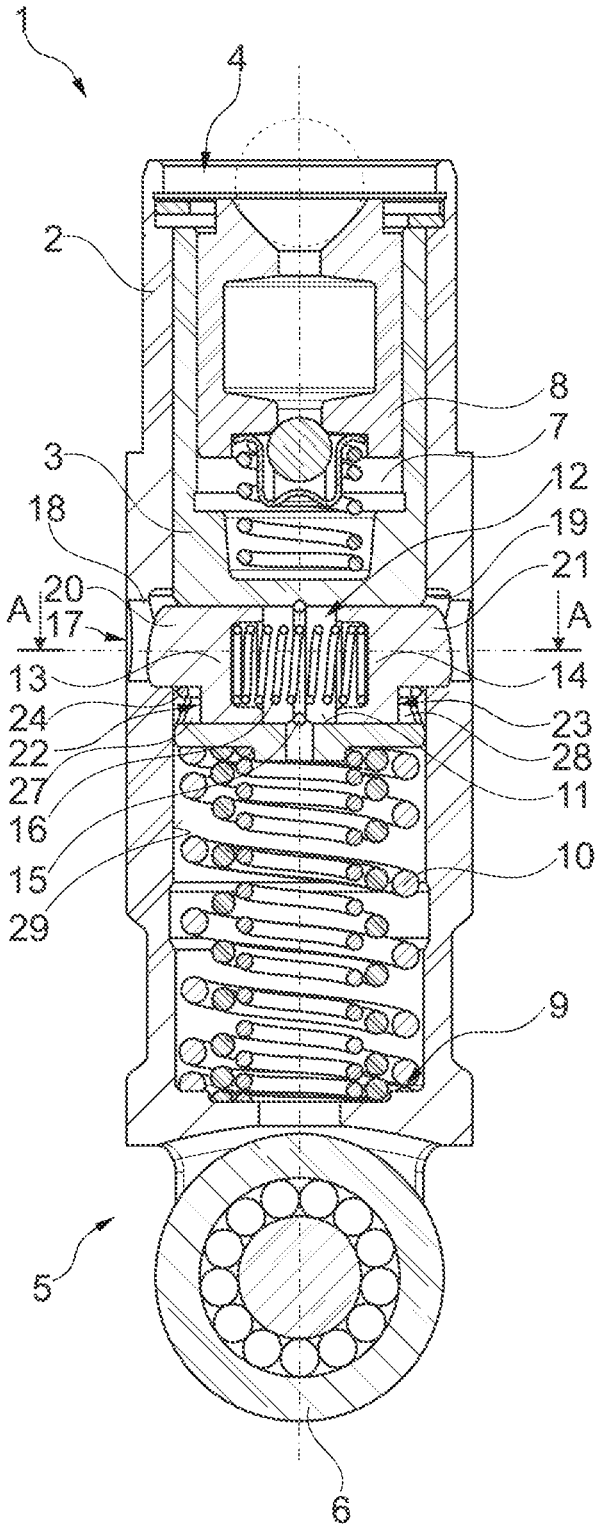
FIG. 1 shows a sectional view of a switching element according to the disclosure corresponding to a first embodiment of the disclosure.

FIG. 1 shows a sectional view of a hydraulic switching element 1 which is intended for use in a valve train of an internal combustion engine and is designed corresponding to a first embodiment of the disclosure. The switching element 1 comprises a hollow-cylindrical external part 2 and a cylindrical internal part 3, which is guided in an axially displaceable manner in the external part 2, particularly in a bore 4 of the external part 2. At an axial end 5, the external part 2 also supports a roller 6, which is provided in an installed state of the switching element 1 for contact with a lifting cam of a camshaft of the valve train. The internal part 3 also accommodates in an inner region 7 a play compensation element 8 which, in the installed state of the switching element 1, makes contact with a follower member, which is in particular a push rod. In this respect, the hydraulic switching element 1 is embodied here as a roller tappet.

A lost motion spring set 10 is also accommodated between a bottom region 9 of the external part 2 and the internal part 3, via which the internal part 3 is pretensioned axially in a direction of extension from the external part 2. In the installed state of the switching element 1, a permanent contact of the internal part 3 with the follower member is thereby ensured when the external part 2 contacts the lifting cam with the roller 6, even if the internal part 3 can be displaced axially relative to the external part 2.

Figure 2:
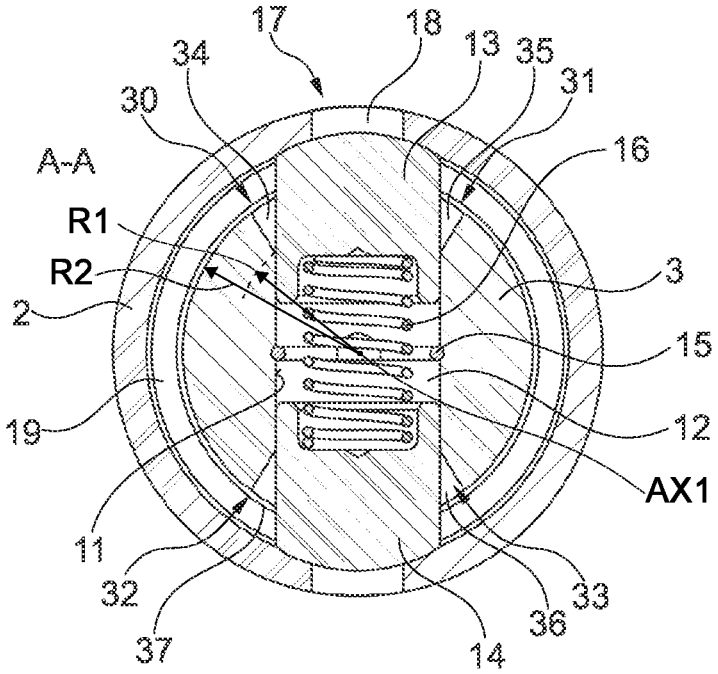
FIG. 2 shows a further sectional view of the switching element from FIG. 1.

As can be seen in FIG. 1 and also in the further sectional view in FIG. 2, the internal part 3 is radially interspersed with a through bore 11, which forms a receptacle 12 for two radially opposed locking elements 13 and 14. The locking elements 13 and 14 are each guided in a radially displaceable manner in the receptacle 12, wherein a radial insertion of the individual locking element 13 or 14 into the through bore 11 of the internal part 3 is limited by a stop in the form of a circlip 15. In addition, the locking elements 13 and 14 radially accommodate a spring element 16 therebetween, which in the present case is designed as a helical spring and pretensions the two locking elements 13 and 14 against one another radially outwards.

On the side of the external part 2 there is a recess 17 which is composed of a through bore 18 and an annular groove 19 connected thereto, and which can be supplied with hydraulic fluid radially from outside via the through bore 18. The through bore 18 penetrates the external part 2 in the radial direction, wherein the through bore 18 then merges radially on the side of the axially running bore 4 into the annular groove 19 which radially surrounds the internal part 3 in this axial region.

In FIG. 1, the external part 2 and the internal part 3 are positioned axially with respect to one another in a coupled position in which the through bore 11 and thus also the receptacle 12 of the locking elements 13 and 14 are overlapped by the recess 17. When there is no pressure supply to the recess 17, the locking elements 13 and 14 are each pretensioned radially outwards via the spring element 16 into a locking position in which the respective locking elements 13 and 14 are enclosed with a respective locking section 20 or 21 in the recess 17. As a result, the external part 2 and the internal part 3 are positively coupled to one another in the axial direction, so that the axial displacement of the internal part 3 relative to the external part 2 is prevented.

The respective locking section 20 or 21 of the individual locking element 13 or 14 is defined here by a flattened portion 22 or 23—seen in FIG. 1—which is respectively introduced into the individual locking element 13 or 14 in a respectively radially outwardly oriented end. The flattened portions 22 and 23 are used in the switching element 1 to prevent the locking elements 13 and 14 from rotating in the receptacle 12, in that an anti-rotation means 24 in the form of a circlip is enclosed in the flattened portions 22 and 23. The anti-rotation means 24 is accommodated in a circumferential groove 25 on the internal part 3, which can be seen in FIG. 3 in the perspective single view of the internal part 3, and is designed on an outer jacket 26 of the cylindrical internal part 3. The circumferential groove 25 is located at a longitudinal position of the internal part 3 defined by a longitudinal distance L1. The circumferential groove 25 extends from the outer jacket 26 to a depth D1.

The flattened portions 22 and 23 also delimit a chamber 27 or 28 which defines the individual locking element 20 or 21 together with the receptacle 12 of the internal part 3 and an inner jacket 29 of the external part 2 formed by the bore 4.

The recess 17 of the external part 2 can be supplied with hydraulic fluid in the form of oil from the radial outside, thereby building up a control pressure which acts on the end faces of the locking sections 20 and 21 of the locking elements 13 and 14, and reaching a certain pressure threshold causes a radial insertion of the locking elements 13 and 14 from the locking positions shown in FIG. 1 against the spring element 16 in the receptacle 12. The locking elements 13 and 14 can be displaced completely into the receptacle 12 by the control pressure until they come into contact with the circlip 15 in a respective release position, so that the locking sections 20 and 21 are no longer enclosed in the recess 17 of the external part 2. As a result, the internal part 3 can be displaced axially relative to the external part 2.

However, in the respective locking position of the respective locking element 13 or 14, the respective chamber 27 or 28 is spatially separated and directly fluidly disconnected from the recess 17 by the respective locking section 20 or 21, so that hydraulic fluid initially cannot flow directly from the recess 17 into the respective chamber 27 or 28. This direct inflow can only take place from a displacement path in which the respective locking element 13 or 14 has already been displaced back radially so far into the receptacle 12 that the respective locking section 20 or 21 releases the respective chamber 27 or 28 from the recess 17 of the external part 2.

However, if the fluid connection between the chamber 27 and 28 and the recess 17 were not established until after this displacement path, this would briefly result in a drop in the control pressure, since the chamber 27 or 28 must first be filled with hydraulic fluid. To avoid this effect and also to be able to apply pressure to the individual locking element 13 or 14 on a larger surface at the front, bypasses 30 to 33 are provided in the switching element 1, via which the individual chamber 27 or 28 is fluidly connected indirectly to the recess 17.

Figure 3:
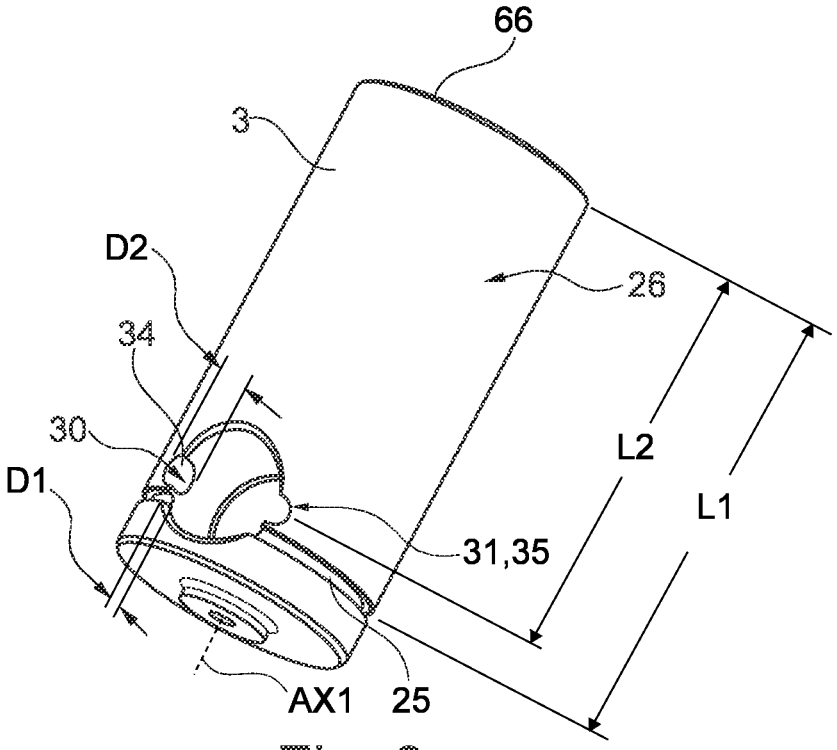
FIG. 3 shows a perspective individual view of an internal part of the switching element from FIG. 1.
Figure 4:
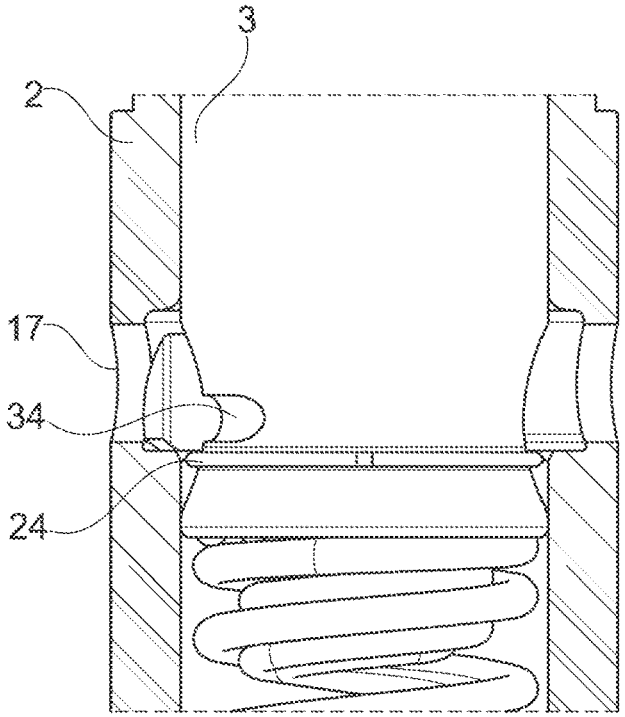
FIG. 4 shows a further sectional view of the switching element from FIG. 1.

As can be seen in FIGS. 2 to 4, the bypasses 30 to 33 are designed as cut-outs 34 to 37, which are designed in detail on a wall of the receptacle 12 in the force-free region, and starting from the mouth of the receptacle 12 extend to the outer jacket 26 of the internal part 3. Radially, the cut-outs 34 to 37 are designed with an extent such that hydraulic fluid can flow past the respective locking element 13 or 14 into the respective chamber 27 or 28. As shown in FIG. 3, the cut-outs 34 to 37 are located at a longitudinal position of the internal part 3 defined by a longitudinal distance L2. The cut-outs 34 to 37 are arranged axially between the circumferential groove 25 and an upper end 66 of the internal part 3 (relative to a longitudinal center axis AX1 of the internal and external parts). As shown in FIGS. 2 and 3, a radially inner-most end of the cut-outs 34 to 37 that penetrates the receptacle 12 is located at a radial position defined by a radial distance R1 (relative to the longitudinal center axis AX1 of the internal and external parts), and a radially outer-most end of the cut-outs 34 to 37 that penetrates both the outer jacket 26 and the receptacle 12 is located at a radial position defined by a radial distance R2 (relative to the longitudinal center axis AX1 of the internal and external parts). Relative to the outer jacket 26 of the internal part 3, the radially inner-most end of the cut-outs 34 to 37 is located at a depth D2 within the receptacle 12.

Figure 5:
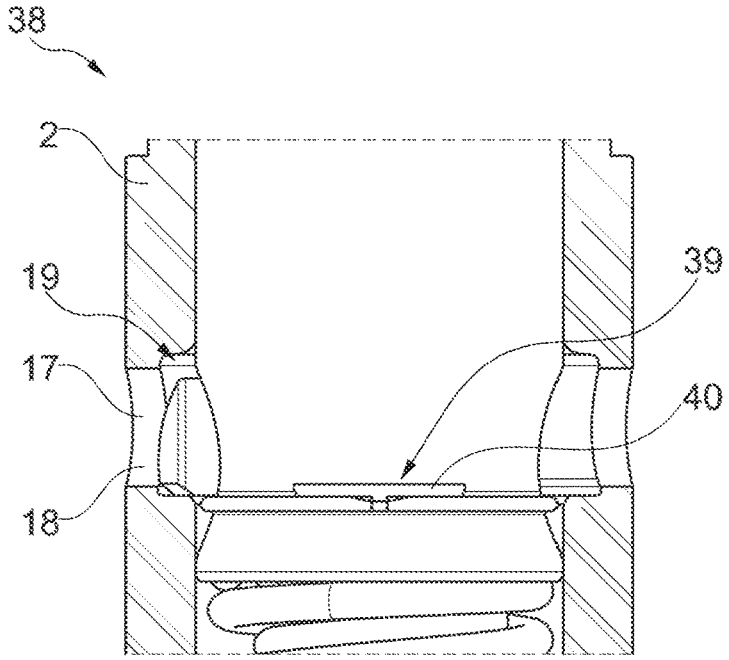
FIG. 5 shows a sectional view of a part of a switching element according to the disclosure according to a second possible embodiment of the disclosure.
Figure 6:
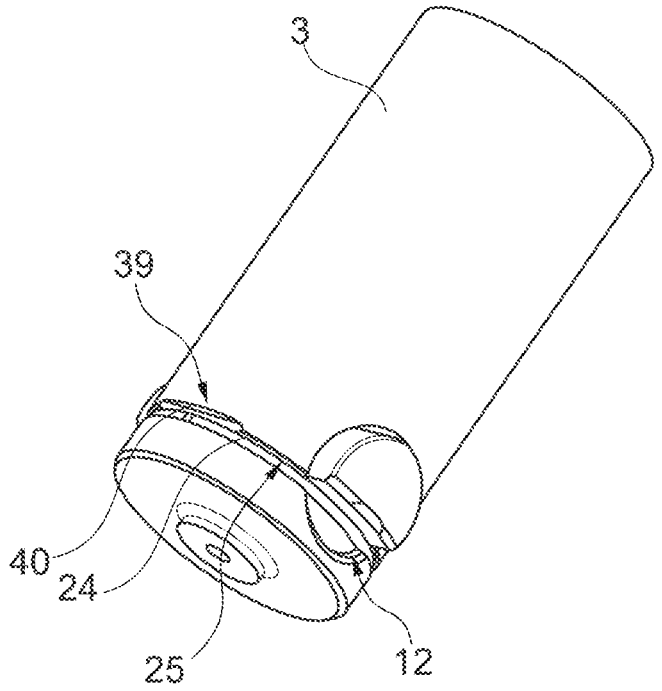
FIG. 6 shows a perspective view of a part of the switching element from FIG. 5.

Furthermore, FIGS. 5 and 6 show parts of a switching element 38 which is designed corresponding to a second possible embodiment of the disclosure and essentially corresponds to the previous variant according to FIGS. 1 to 4. The difference here, however, is that in this case an indirect fluid connection of the respective chamber 27 or 28 with the recess 17 of the external part 2—not shown in FIGS. 5 and 6 but corresponding to the chamber shown in FIGS. 1 to 4—is made via a bypass 39, which is introduced as a slit-like depression 40 in the outer jacket 26 of the internal part 3. This depression 40 spatially fluidly connects the annular groove 19 of the external part 2 with the groove 25 in which the anti-rotation means 24 is accommodated. Accordingly, via the depression 40, hydraulic fluid can permanently flow from the through bore 18 of the recess 17 via the annular groove 19 into the groove 25, which merges into the receptacle 12 and accordingly creates a spatial fluid connection between the respective chamber 27 or 28 and the depression 40. The indirect fluid connection of the recess 17 to the respective chamber 27 or 28 that is realized in this way is permanent. Otherwise, the possible embodiment according to FIGS. 5 and 6 corresponds to the variant according to FIGS. 1 to 4, so that reference is made to what has been described in this regard.

Figure 7:
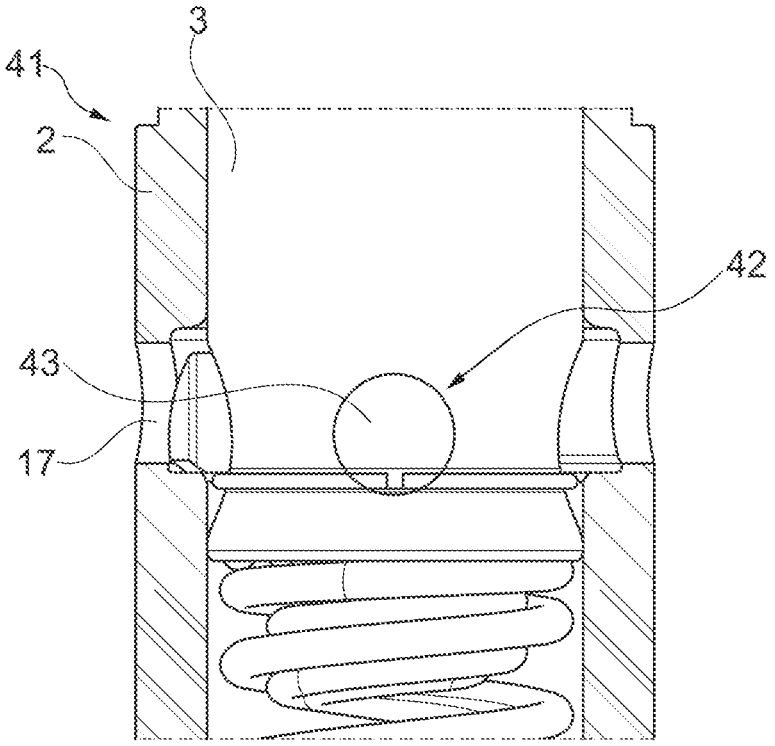
FIG. 7 shows a sectional view of a part of a switching element corresponding to the disclosure according to a third embodiment of the disclosure.
Figure 8:
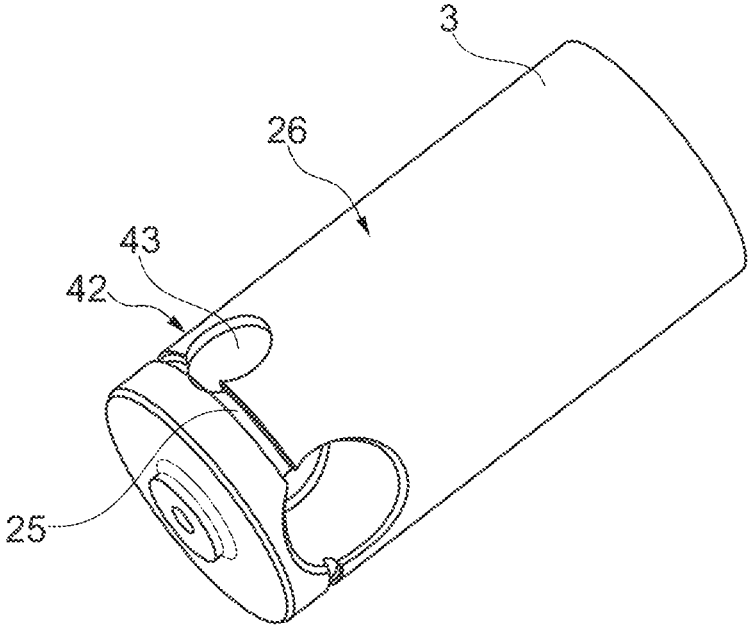
FIG. 8 shows a perspective individual view of an internal part of the switching element from FIG. 7.

FIGS. 7 and 8 also show partial views of a switching element 41, which is designed according to a third embodiment of the disclosure and largely corresponds to the previous possible embodiment according to FIGS. 5 and 6. In this case, too, an indirect connection is established via a bypass 42, which is introduced as a depression 43 in the outer jacket 26 of the external part 3 and fluidly connects the groove 25 to the recess 17. In contrast to the variant according to FIGS. 5 and 6, the depression 43 is circular in this case. Otherwise, the embodiment according to FIGS. 7 and 8 corresponds to the variant according to FIGS. 5 and 6, so that reference is made to what has been described in this regard.

Figure 9:
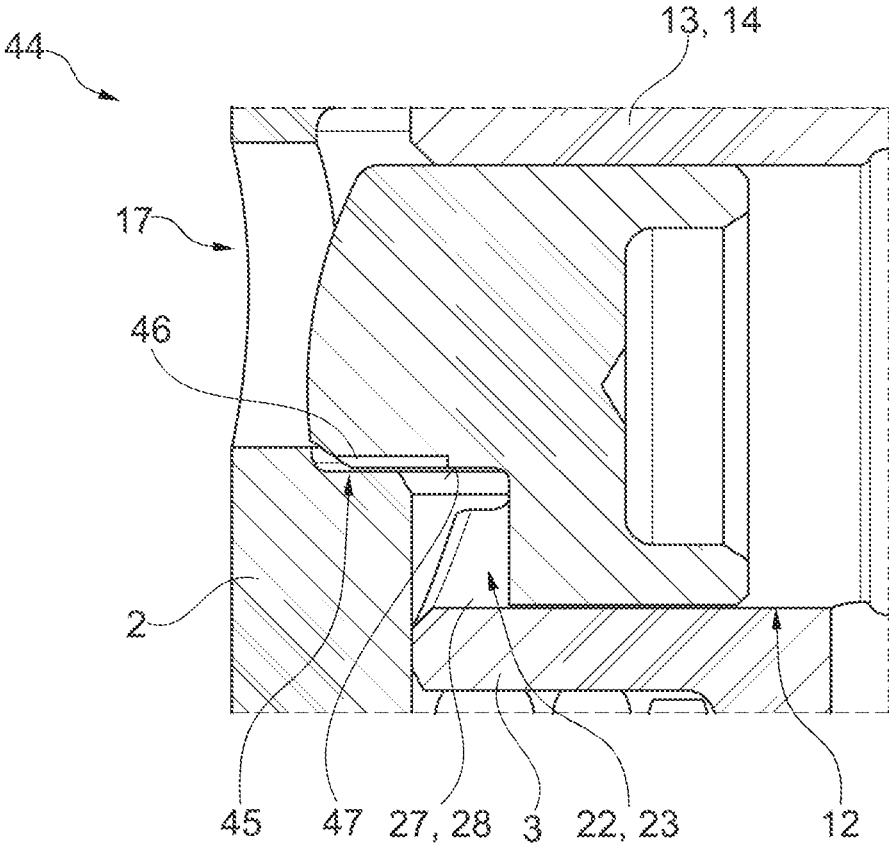
FIG. 9 shows a sectional view of a part of a switching element according to the disclosure according to a fourth possible embodiment of the disclosure.
Figure 10:
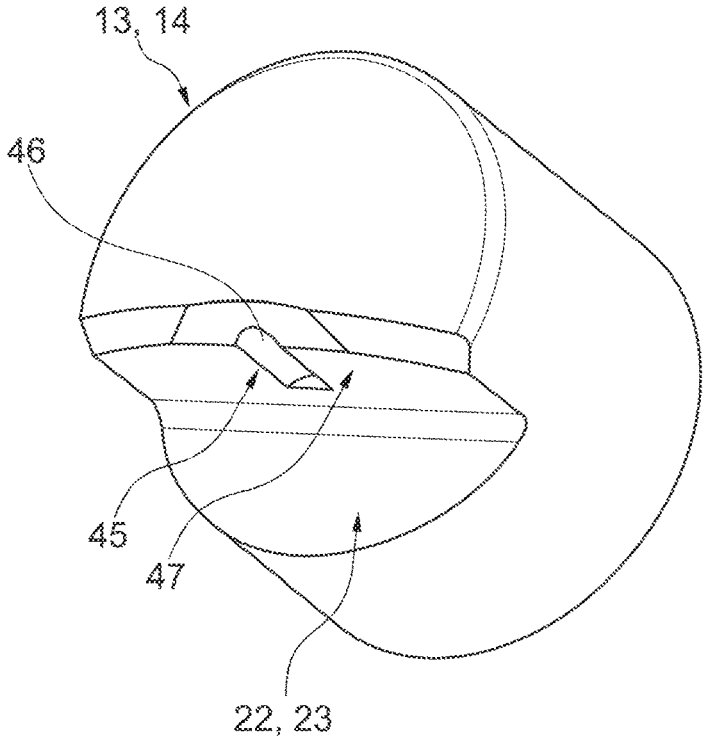
FIG. 10 shows a perspective individual view of a locking element of the switching element from FIG. 9.

FIGS. 9 and 10 also show parts of a switching element 44 corresponding to a fourth possible embodiment of the disclosure, wherein the switching element 44 essentially corresponds to the variant according to FIGS. 1 to 4. Here, the switching element 44 is shown in FIG. 9 in the area of the individual locking element 13 or 14, which is respectively radially displaceably guided in the receptacle 12 of the internal part 3 as in the variant according to FIGS. 1 to 4. In contrast to the variant according to FIGS. 1 to 4, instead of bypasses on the internal part 3, a respective bypass 45 is now configured in the region of the individual locking element 13 or 14. As can be seen in conjunction with an individual view of the individual locking element 13 or 14 in FIG. 10, the bypass 45 is realized by a recess 46 in the form of a notch, which is designed on a contact surface 47.

This contact surface 47 is defined by the respective flattened portion 22 or 23, and makes axial contact with the annular groove 19 of the external part 2 in the respective locking position of the locking element 13. The cut-out 46 subsequently forms an indirect fluid connection of the respective chamber 27 or 28 with the recess 17 of the external part 2, wherein hydraulic fluid is able to flow from the recess 17 into the respective chamber 27 or 28 via this fluid connection. Otherwise, the possible embodiment according to FIGS. 9 and 10 corresponds to the variant according to FIGS. 1 to 4, so that reference is made to what has been described in this regard.

Figure 11:
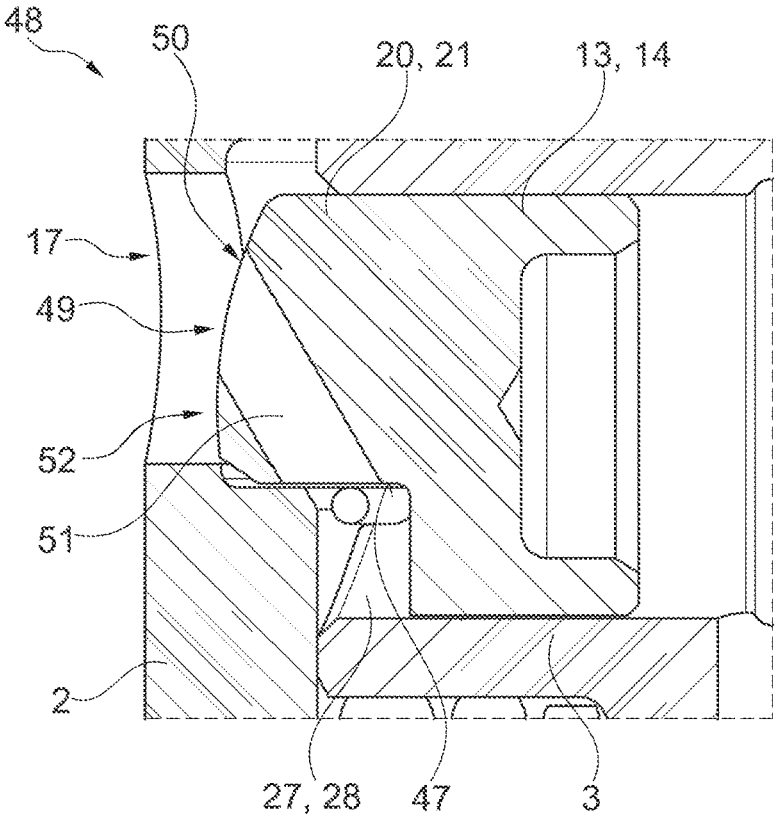
FIG. 11 shows a sectional view of a part of a switching element according to the disclosure corresponding to a fifth embodiment of the disclosure.
Figure 12:
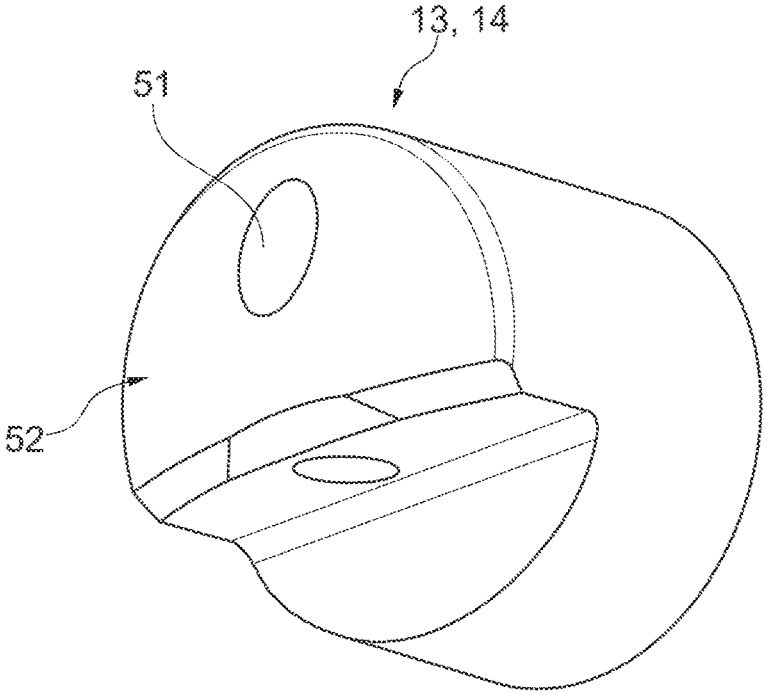
FIG. 12 shows a perspective individual view of a locking element of the switching element from FIG. 11.
Figure 13:
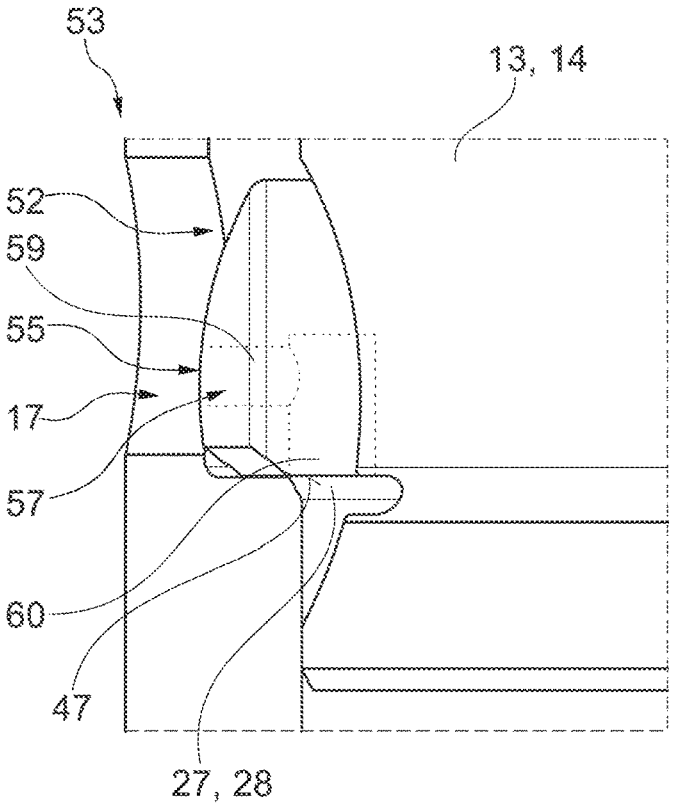
FIG. 13 shows a sectional view of part of a switching element according to the disclosure according to a sixth possible embodiment of the disclosure.
Figure 14:
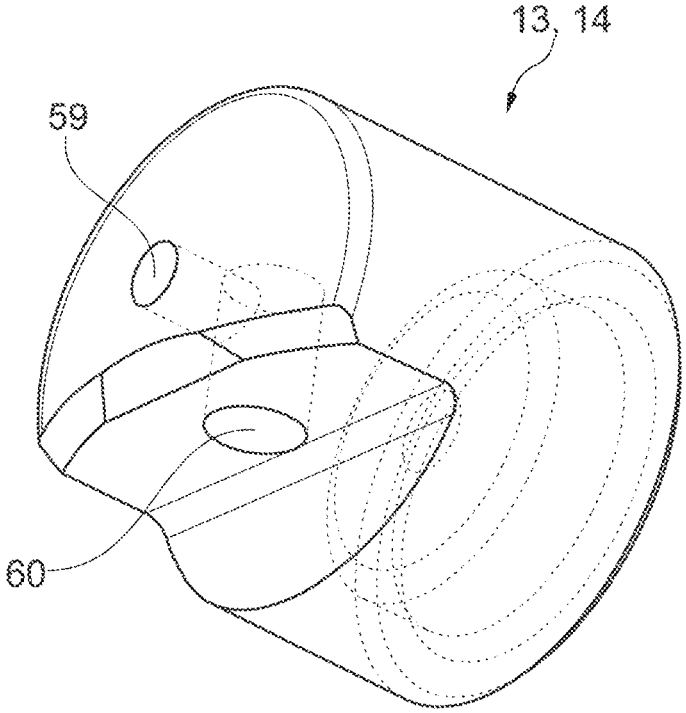
FIG. 14 shows a perspective individual view of a locking element of the switching element from FIG. 13.

A respective bypass 49 is also implemented in the region of the respective locking element 13 or 14 in the case of a switching element 48, of which individual details are shown in FIGS. 11 and 12. The switching element 48 is implemented according to a fifth embodiment of the disclosure and essentially corresponds to the previous variant according to FIGS. 9 and 10. The only difference here is that the bypass 49 is formed in this case by a cut-out 50 which runs as a sloping bore 51 from an end face 52 of the respective locking section 20 or 21 to the respective chamber 27 or 28. The bore 51 opens out radially as a channel on the contact surface 47 in a region at which no contact is made with the external part 2 in the respective locking position. Accordingly, hydraulic fluid can flow directly from the recess 17 of the external part 2 via the bore 51 into the respective chamber 27 or 28. Otherwise, the embodiment according to FIGS. 11 and 12 corresponds to the variant according to FIGS. 9 and 10, so that reference is made to what has been described in this regard.

Likewise, in the further embodiments of a switching element 53 or 54 according to FIGS. 13 and 14, or 15 and 16, a respective bypass 55 or 56 is realized as a cut-out 57 or 58 in the respective locking element 13 or 14. In this respect, these embodiments essentially correspond to the variant according to FIGS. 11 and 12, wherein in contrast to the embodiment according to FIGS. 13 and 14, the cut-out 57 is realized by two holes 59 and 60, from which the hole 59 runs radially from the end face 52 and the hole 60 extends axially starting from the contact surface 47. Within the respective locking element 13 or 14, the two bores 59 and 60 intersect or meet and thereby together form the cut-out 57, via which as a new channel hydraulic fluid can flow permanently from the cut-out 17 into the respective chamber 27 or 28.

Figure 15:
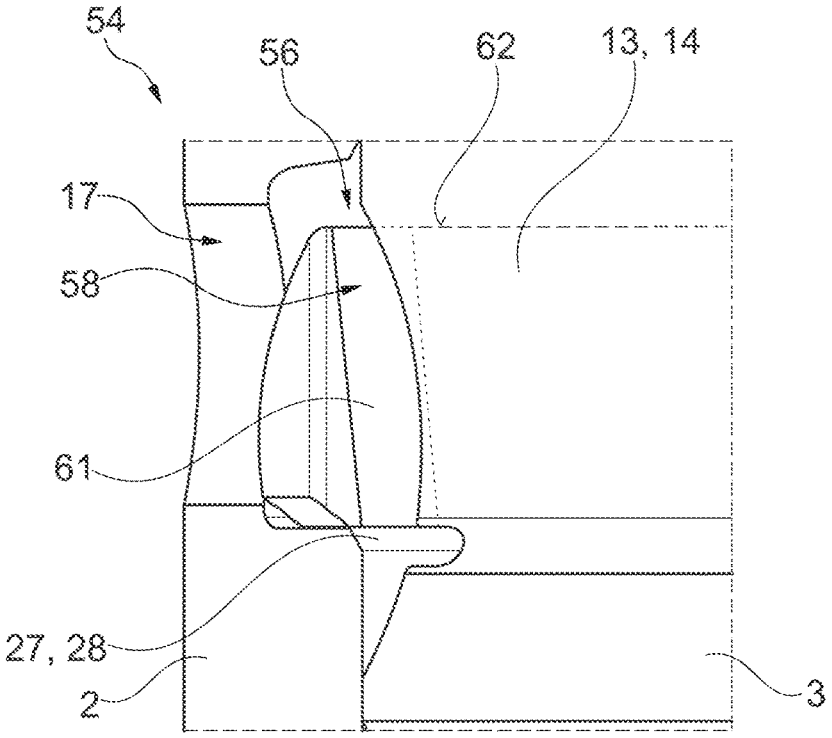
FIG. 15 shows a sectional view of a part of a switching element corresponding to the disclosure according to a seventh embodiment of the disclosure.
Figure 16:
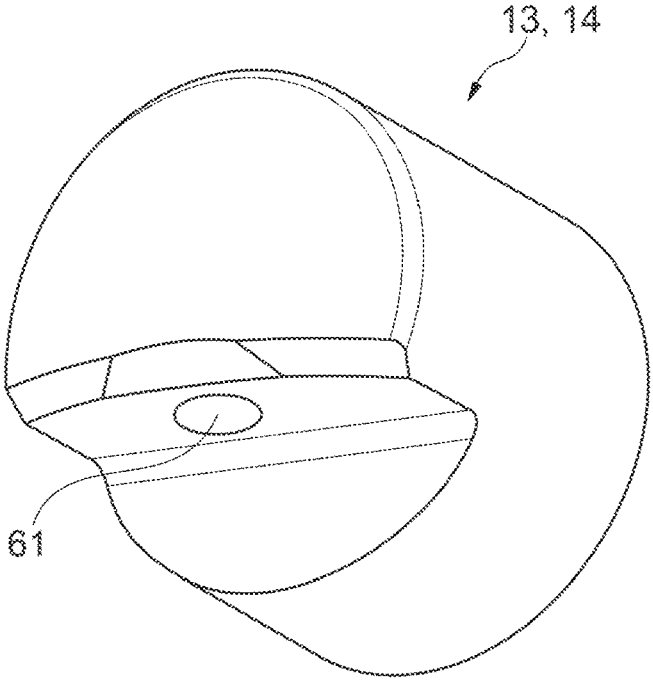
FIG. 16 shows a perspective individual view of a locking element of the switching element from FIG. 15.

In contrast, in the embodiment according to FIGS. 15 and 16, the cut-out 58 in the respective locking element 13 or 14 is formed by a bore 61, which in this case, however, extends from a cylindrical guide surface 62 of the respective locking element 13 or 14 and through the respective locking element 13 or 14 so that it fluidly connects the recess 17 to the chamber 27. Accordingly, the bore 61 is covered by the receptacle 12 of the internal part 3 after a certain radial displacement of the respective locking element 13 or 14, and is therefore to be arranged in such a way that this covering or overlapping only occurs after a direct fluid connection of the chamber 27 or 28 to the recess 17. Otherwise, the embodiments according to FIGS. 13 and 14 as well as 15 and 16 correspond to the variant according to FIGS. 11 and 12, so that reference is made to what has been described in this regard.

Figure 17:
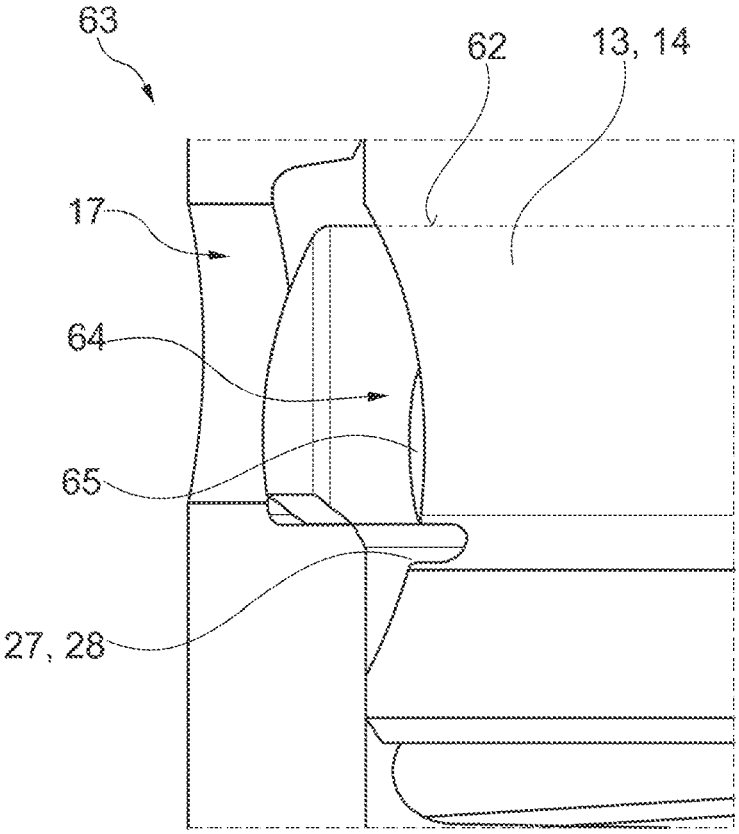
FIG. 17 shows a sectional view of part of a switching element according to an eighth possible embodiment of the disclosure.
Figure 18:
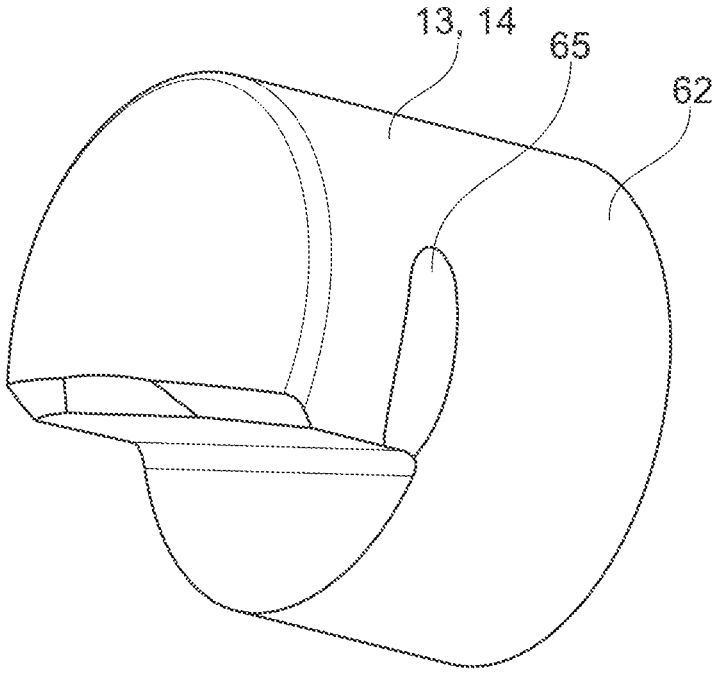
FIG. 18 shows a perspective individual view of a locking element of the switching element from FIG. 17.

Finally, FIGS. 17 and 18 show parts of a switching element 63 according to a further possible embodiment of the disclosure. This possible embodiment largely corresponds to the variant according to FIGS. 9 and 10, in that in this case a respective bypass 64 is implemented as a cut-out 65 in the region of the respective locking element 13 or 14. However, in contrast to the variant according to FIGS. 9 and 10, the respective cut-out 65 is formed tangentially on the cylindrical guide surface 62 of the respective locking element 13 or 14. As can be seen in particular in FIG. 17, this cut-out 65 is provided radially in a region of the cylindrical guide surface 62, so that in the respective locking position of the respective locking element 13 or 14, the indirect fluid connection of the respective chamber 27 or 28 with the recess 17 is already established and maintained until the respective chamber 27 or 28 and the recess 17 are directly fluidly connected to each other. In all other respects, the possible embodiment according to FIGS. 17 and 18 corresponds to the variant according to FIGS. 9 and 10, so that reference is made to what has been described in this regard.

The aforementioned variants of a switching element can be combined with one another as desired with regard to the design of one or a plurality of bypasses. A bypass in the region of the respective locking element can be combined with a bypass on the internal part.

A hydraulic switching element with improved switching characteristics can be created in each case by means of the configurations according to the disclosure.

LIST OF REFERENCE SYMBOLS

1 Switching element
2 External part
3 Internal part
4 Bore
5 End
6 Roller
7 Inner region
8 Play compensation element
9 Bottom region
10 Lost motion spring set
11 Through bore
12 Receptacle
13 Locking element
14 Locking element
15 Circlip
16 Spring element
17 Recess
18 Through bore
19 Annular groove
20 Locking section
21 Locking section
22 Flattened portion
23 Flattened portion
24 Anti-rotation means
25 Groove
26 Outer jacket
27 Chamber
28 Chamber
29 Inner jacket
30 Bypass
31 Bypass
32 Bypass
33 Bypass
34 Cut-out
35 Cut-out
36 Cut-out
37 Cut-out
38 Switching element
39 Bypass
40 Depression
41 Switching element
42 Bypass
43 Depression
44 Switching element
42 Bypass
46 Cut-out
47 Contact surface
48 Switching element
49 Bypass
50 Cut-out
51 Bore
52 End face
53 Switching element
54 Switching element
55 Bypass
56 Bypass
57 Cut-out
58 Cut-out
59 Bore
60 Bore
61 Bore
62 Guide surface
63 Switching element
64 Bypass
65 Cut-out

The invention claimed is:

1. A switching element for a valve train of an internal combustion engine, the switching element comprising:

an external part;

an internal part configured to be: i) axially displaced in a bore of the external part and, ii) displaced relative to the external part into a coupling position in which at least one radially extending receptacle of the internal part overlaps with at least one radially extending recess of the external part, the internal part having a circumferential groove arranged on an outer jacket, the circumferential groove configured to intersect the at least one radially extending receptacle; and at least one locking element slidably guided within the at least one radially extending receptacle, the at least one locking element having a flattened portion on a radially outwardly directed end, and anti-rotation of the at least one locking element relative to the at least one radially extending receptacle is provided via the circumferential groove; and a locking section defined on the flattened portion of the at least one locking element, the locking section engaging in the at least one radially extending recess of the external part in a locking position of the at least one locking element and in the coupling position of the internal part and the external part; and the at least one radially extending recess of the external part is configured to be acted upon by a control pressure and the at least one locking element is configured to be radially displaced from the locking position to a release position, in which the at least one locking element is displaced radially inwardly via the control pressure into the at least one radially extending receptacle; and at least in the locking position of the at least one locking element, a chamber delimited by the at least one locking element is spatially separated from the at least one radially extending recess of the external part by the locking section; and when the locking section is in axial contact with the external part in the locking position, at least one bypass is configured to indirectly fluidly connect the at least one radially extending recess of the external part and the chamber; and the at least one bypass is formed by a cut-out having:

a first end arranged on the at least one radially extending receptacle at a first radial position relative to a longitudinal center axis of the internal part; and a second end arranged on the at least one radially extending receptacle at a second radial position relative to the longitudinal center axis of the internal part, the second radial position different than the first radial position, and wherein the cut-out is arranged axially between the circumferential groove and an upper end of the internal part relative to the longitudinal center axis of the internal part.

2. The switching element according to claim 1, wherein the first end of the cut-out is configured to widen the at least one radially extending receptacle at least in a mouth region thereof onto the outer jacket of the internal part, the cut-out forming a passage from the at least one radially extending recess of the external part, past the at least one locking element, and into the chamber.

3. The switching element according to claim 1, wherein the at least one bypass is configured to deliver the control pressure to the chamber, the control pressure configured to move the at least one locking element from the locking position to the release position.

4. The switching element according to claim 1, wherein the first end of the cut-out penetrates the outer jacket.

5. The switching element according to claim 1, wherein the cut-out extends linearly between the first and second ends.

6. A switching element for a valve train of an internal combustion engine, the switching element comprising:

an external part;

an internal part, configured to be: i) axially displaced in a bore of the external part and, ii) -displaced relative to the external part into a coupling position in which at least one radially extending receptacle of the internal part overlaps with at least one radially extending recess of the external part; and at least one locking element slidably guided within the at least one radially extending receptacle, the at least one locking element having a flattened portion on a radially outwardly directed end; and a locking section defined on the flattened portion of the at least one locking element, the locking section engaging in the at least one radially extending recess of the external part in a locking position of the at least one locking element and in the coupling position of the internal part and the external part; and the at least one radially extending recess of the external part is configured to be acted upon by a control pressure and the at least one locking element is configured to be radially displaced from the locking position to a release position, in which the at least one locking element is displaced radially inwardly via the control pressure into the at least one radially extending receptacle; and at least in the locking position of the at least one locking element, a chamber delimited by the at least one locking element is spatially separated from the at least one radially extending recess of the external part by the locking section; and when the locking section is in axial contact with the external part in the locking position, at least one bypass is arranged to indirectly fluidly connect the at least one radially extending recess of the external part to the chamber at least until the chamber is fluidly connected directly to the at least one radially extending recess during a course of displacement of the at least one locking element; and the at least one bypass is formed by a cut-out arranged on or within the at least one locking element.

7. The switching element according to claim 6, wherein the cut-out is arranged on a contact surface of the flattened portion of the at least one locking element, the contact surface axially engaged with the external part when the locking section is in axial contact with the external part in the locking position.

8. The switching element according to claim 6, wherein the cut-out is formed tangentially on a cylindrical guide surface on which the at least one locking element is slidably guided within the at least one radially extending receptacle of the internal part, and the cut-out is separate from the flattened portion and extends from the flattened portion so that hydraulic fluid flows from the at least one radially extending recess to the cut-out and then from the cut-out to the chamber formed by the flattened portion.

9. The switching element according to claim 6, wherein the at least one bypass is formed by at least one bore extending within the at least one locking element and which opens into the chamber.

10. The switching element according to claim 9, wherein the at least one bore extends within the at least one locking element from a front face of the locking section or from a cylindrical guide surface on which the at least one locking element is slidably guided within the at least one radially extending receptacle of the internal part.

11. The switching element according to claim 10, wherein the at least one bore in the at least one locking element comprises a plurality of bores which intersect within the at least one locking element.

12. The switching element of claim 6, wherein the cut-out comprises a bore extending within the at least one locking element, and the bore of the at least one locking element is covered by the at least one radially extending receptacle in the release position of the at least one locking element, and the bore of the at least one locking element is not covered by the at least one radially extending receptacle in the locking position.

13. The switching element according to claim 6, wherein the at least one bypass is configured to deliver the control pressure to the chamber, the control pressure configured to move the at least one locking element from the locking position to the release position.

14. A switching element for a valve train of an internal combustion engine, the switching element comprising:

a cylindrical external part having:

a first longitudinally extending bore; and at least one second radially extending bore;

a cylindrical internal part configured to be axially displaceable within the first longitudinally extending bore, the cylindrical internal part having:

at least one radially extending receptacle; and a circumferential groove arranged on an outer jacket of the cylindrical internal part, the circumferential groove extending radially inwardly from the outer jacket such that the circumferential groove defines a first radial depth relative to the outer jacket; and at least one locking element disposed within the at least one radially extending receptacle, the at least one locking element having a flattened portion configured to engage the cylindrical external part in a first locking position of the at least one locking element, the flattened portion forming a chamber with the first longitudinally extending bore, the chamber directly fluidly disconnected from the at least one second radially extending bore in the first locking position, and anti-rotation of the at least one locking element relative to the at least one radially extending receptacle is provided via the circumferential groove; and the at least one second radially extending bore configured to receive a control pressure configured to move the at least one locking element to a second release position; and when the flattened portion is in axial contact with the cylindrical external part in the first locking position, at least one bypass is configured to indirectly fluidly connect the at least one second radially extending bore to the chamber in the first locking position; and the at least one bypass is formed by a cut-out:

extending radially inwardly from the outer jacket of the cylindrical internal part to the at least radially one extending receptacle such that the cut-out penetrates the at least one radially extending receptacle at a second radial depth, the second radial depth: i) relative to the outer jacket, and ii) greater than the first radial depth of the circumferential groove.

15. The switching element of claim 14, wherein the at least one locking element has a cylindrical body configured to slidably engage the at least one second radially extending bore.

16. The switching element of claim 15, wherein the cut-out is arranged on a radial surface of the at least one second radially extending bore.

17. The switching element of claim 14, wherein a circlip configured to provide anti-rotation of the at least one locking element is disposed within the circumferential groove, and the circlip is arranged within the chamber.

18. The switching element of claim 14, wherein the cut-out extends on a radial surface of the at least one second radially extending bore from the outer jacket to the second radial depth.

19. The switching element according to claim 14, wherein the at least one bypass is configured to deliver the control pressure to the chamber, the control pressure configured to move the at least one locking element from the first locking position to the second release position.

20. The switching element according to claim 14, wherein the cut-out and the circumferential groove are arranged at two different longitudinal positions of the cylindrical internal part.

* * * * *